US006394133B1

(12) United States Patent
Knapp

(10) Patent No.: US 6,394,133 B1
(45) Date of Patent: May 28, 2002

(54) FAUCET WITH ADJUSTABLE DELIVERY SPOUT AND OPERATING LEVER

(75) Inventor: Francesco Knapp, Cava Manara (IT)

(73) Assignee: Masco Corporation of India, Taylor, MI (US)

( * ) Notice: Subject to any disclaimer, the term of this patent is extended or adjusted under 35 U.S.C. 154(b) by 0 days.

(21) Appl. No.: 09/701,253

(22) PCT Filed: May 26, 1999

(86) PCT No.: PCT/US99/11592

§ 371 (c)(1),
(2), (4) Date: Nov. 27, 2000

(87) PCT Pub. No.: WO99/61713

PCT Pub. Date: Dec. 2, 1999

(30) Foreign Application Priority Data

May 26, 1998 (IT) ..... TO98A0448

(51) Int. Cl.[7] ..... E03C 1/04

(52) U.S. Cl. ..... 137/615; 4/677; 137/625.17; 137/625.41; 137/801

(58) Field of Search ..... 4/677; 137/615, 137/625.17, 625.41, 801

(56) References Cited

U.S. PATENT DOCUMENTS

| | | | |
|---|---|---|---|
| 3,373,770 | A | 3/1968 | Ward |
| 3,653,407 | A | 4/1972 | Alva |
| 4,262,699 | A | 4/1981 | Fabian |

*Primary Examiner*—Gerald A. Michalsky
(74) *Attorney, Agent, or Firm*—Reising, Ethington, Barnes, Kisselle, Learman & McCulloch, PC

(57) ABSTRACT

A faucet (29) of the type which has an adjustable delivery spout (14) and includes a mixing cartridge (21) with single control lever (25) installed in a cavity or recess (35) available on the faucet. The recess for installation of the cartridge in the valve is formed in a component (11) of the faucet that is integrally formed with the spout (14). The component (11) in which the cartridge is installed has a two-way rotating hydraulic coupling to the fixed body (1) which is operably connected to supply pipes. As the spout (14) is adjusted about the fixed body (1), the lever (25) is carried by the component (11) to retain the same orientation of the lever (25) with respect to the spout (14).

14 Claims, 3 Drawing Sheets

FAUCET WITH ADJUSTABLE DELIVERY SPOUT AND OPERATING LEVER

TECHNICAL FIELD

The field of this invention relates to faucets and more particularly to faucets with an adjustable delivery spout and a single operating lever.

BACKGROUND OF THE DISCLOSURE

Faucets with swivel spouts may easily confuse a user for determining which direction to move the operating lever in order to adjust flow rate of water and to adjust temperature mix. Indeed, in the use of normal faucets equipped with delivery spouts fixed on the faucet body, the user usually orients himself and moves the lever relative to the delivery spout, which is usually directed forward to the user and extending over the working basin or sink. The user is thus led to follow the same criterion with a faucet equipped with an adjustable delivery spout. In this case the user obtains a completely different result when the orientation of the delivery spout is substantially moved in relation to the body of the faucet. The user must orient himself with a forward direction which under certain circumstances may be difficult to precisely observe. The user no longer orients himself with the spout because the mixing cartridge or mixing valve is traditionally installed in a recess or cavity in the fixed body of the faucet. As a result, the position of the operating lever to obtain delivery of a required flow rate of water mixed to a desired temperature must be in reference to a fixed direction with the fixed body. This direction is easily observable when the spout is in a centered forward position. However, when the spout is moved, the direction is less clear to the user. Furthermore, the position of the lever has no relation to the actual orientation of the delivery spout that is adjustable in relation to the fixed body of the valve.

The inconvenience of orienting with the fixed body and not the spout becomes particularly pronounced when the operating lever is of the type commonly referred to as a "joystick" type. In a joystick type faucet, the lever is subject to movement in a first direction to regulate the flow rate from a full flow condition down to a shut-off position and in a second direction which is orthogonal to the first direction to regulate the mixing ratio or temperature mix. The shut-off position is singular, i.e. the faucet is shut off only when the lever is moved to a central position over the fixed delivery spout. When the spout is adjusted to a position other than a central position, the user may experience difficulty in shutting off the flow, or may think he has shut off the flow while in fact this has not happened completely and the faucet will drip. This situation occurs more commonly when the spout is only slightly rotating from its central position, and a person assumes that the spout is centered and moves the lever to align with the spout.

What is needed is therefore to resolve the problem explained above so that the user of a faucet with an adjustable spout can correctly orient the lever to correctly adjust flow rate and temperature and be assured that the faucet is completely shut off. This assurance should be equally ascertained for all rotated directions of the adjustable spout.

SUMMARY OF THE DISCLOSURE

In accordance with one aspect of the invention, the recess or cavity for installation of the mixing cartridge on the faucet is in a component of the faucet mounted for rotation with the delivery spout, that in turn is adjustable in relation to the fixed body of the faucet. Because of this feature, the cartridge valve installed in the faucet rotates together with the delivery spout. When the orientation of the spout in relation to the fixed body of the faucet is altered, the orientation for correct movement of the operating lever also rotates correspondingly. The user can then operate the lever by adopting the same criteria he is accustomed to adopt in operating faucets with fixed delivery spouts, and this is translated into greater ease of operation.

Preferably the orientation of the mixing cartridge is pre-determined by a recess in the same component of the faucet which integrally forms its adjustable spout.

Preferably the faucet employs a mixing cartridge of the open type, offering lateral delivery openings, and the component in which the orientation for the mixing cartridge is pre-determined offers a peripheral area into which the delivery openings of the mixing cartridge open and which communicate directly with an internal passage of the delivery spout.

Preferably, for the purpose of ensuring proper supply to the mixing cartridge in any position of the delivery spout of the valve, the component in which the orientation of the mixing cartridge is predetermined offers a two-way rotating hydraulic coupling in relation to the fixed body of the faucet that in turn is connected to the supply pipes. Preferably this rotating hydraulic coupling involves a central passage connected to one of the supply pipes and a peripheral chamber at least partially ring-shaped, connected to the other supply pipe.

BRIEF DESCRIPTION OF THE DRAWINGS

Reference now is made to the accompanying drawings in which.

DETAILED DESCRIPTION OF THE PREFERRED EMBODIMENT

Figure 1:
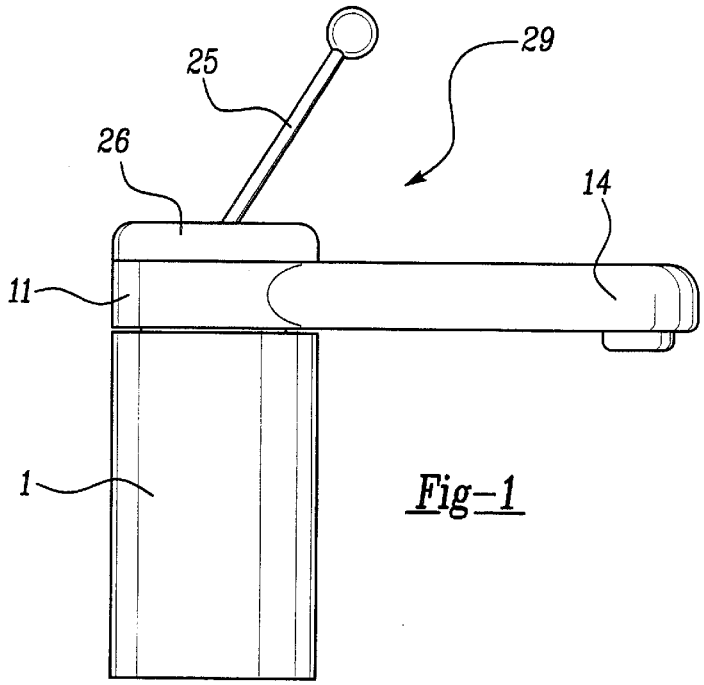
FIG. 1 illustrates an external view of a form of embodiment of the faucet whose fixed body offers an adjustable delivery spout.

Referring now to FIG. 1, a faucet 29 has a fixed body 1 on which is mounted a rotating component 11 which forms a delivery spout 14. A cover 26 holds a mixing cartridge 21 in place inside the faucet 29. The cartridge is equipped with an operating lever 25. The lever 25 is shown in the form of an erect straight pole and is of the type commonly referred to as a "joystick". As noted, this operating lever 25 can be moved in a first direction (in the plane of the drawing as shown in FIG. 1) to adjust the flow rate of mixed water between full flow and a shut-off position. In the drawings the control lever 25 is represented in the shut-off position. The operating lever can also be moved in a direction orthogonal to the first direction (perpendicular to the plane of the drawing) to regulate the mixing ratio between cold and hot water.

Figure 2:
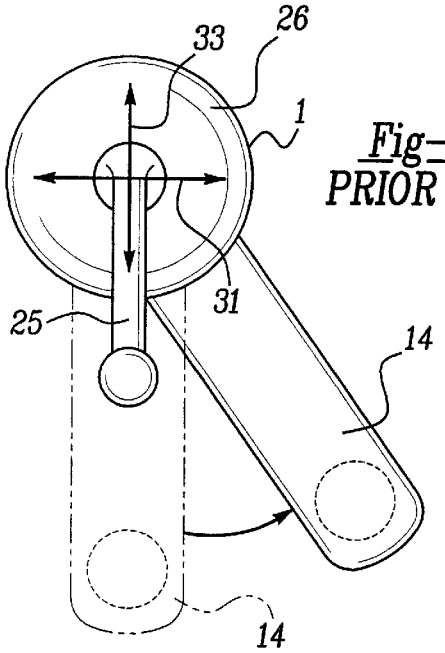
Fig-2 PRIOR ART
FIG. 2 is a top plan view of a faucet with an adjustable spout in accordance with the prior art illustrating how the spout when rotated becomes aslant with the orientation for operation of the operating lever.

In order for one to use the faucet properly, the user must know these directions of movement of the operating lever 25. The delivery spout 14 is the only part of the faucet that has a prominent extension for indicating a well-defined direction. Because many faucets have fixed delivery spouts, the user habitually takes the direction of the delivery spout 14 as reference for correct operation of the control lever 25. The operator is thus instinctively or intuitively led to adopt the same criterion or orientation even when the delivery spout is adjustable. However, in this case, known faucets with adjustable spouts may mislead the user as shown in FIG. 2. The direction shown by the delivery spout 14 varies, as shown by the difference between a first centered position shown in phantom and a second rotated position. It is noted that the directions of movement of the lever 25 of the mixing cartridge, which is installed in a cavity or recess on the fixed body 1 of the faucet always remain unchanged and therefore has a variable relationship with the direction of the delivery spout 14. As shown in FIG. 2, when the spout is rotated, the two orthogonal axes of motion 31,33 of the control lever 25 become aslant with respect to the spout 14, and the lever 25 become s aslant with respect to the spout 14 when in the shut-off position.

Figure 3:
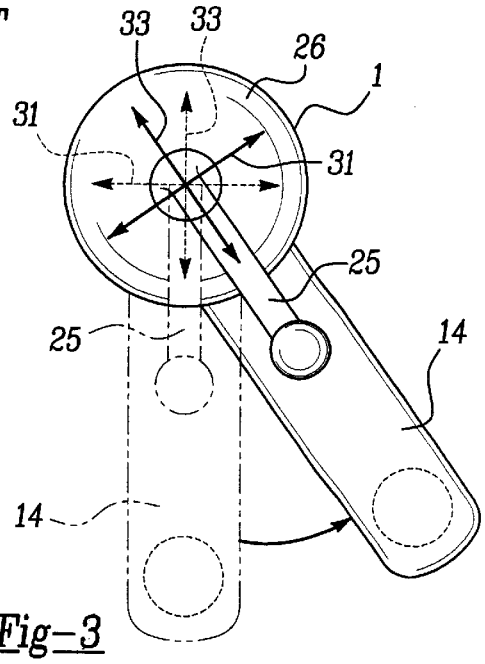
FIG. 3 is a top plan view of the faucet shown in FIG. 1 illustrating the corresponding orientation for operation of the operating lever when the spout is rotationally adjusted between two positions.
Figure 4:
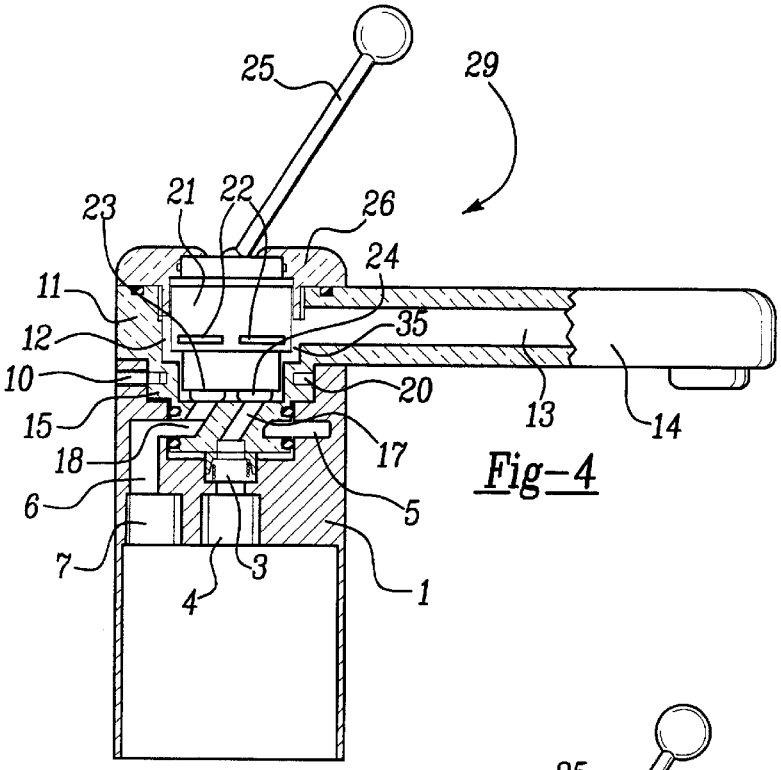
FIG. 4 shows a segmented view of the valve as in FIG. 1, illustrating the internal components of this invention.

In the invention, as is shown in FIG. 4, the mixing cartridge 21 from which the control lever 25 extends is in fact installed in a cavity or recess 35 of a rotating component 11. The component 11 has the delivery spout 14 integrally formed therewith. The cartridge is retained in the component 11 by the cover 26 which, in this case is secured to the rotating component 11. The longitudinal axis of the cartridge 21 is aligned with the axis of rotation of the spout 14. Consequently, when the delivery spout 14 is adjusted in relation to the fixed body 1, the rotating component 11 also turns, and the mixing cartridge 21 also rotates together with these parts, as illustrated in FIG. 3. Therefore, the two axes of movement 31,33 of the operating lever 25 rotate in relation to the fixed body 1, and remain constant or fixed with respect to the spout 14. This fixed relation to the spout is shown in FIG. 3 by the comparison of the two sets of orthogonal axis 31,33. One set is in phantom corresponding to the phantom spout position and the second set is solid corresponding to the rotated solid spout position. The lever 25 also retains its own orientation with respect to the delivery spout 14. If the spout 14 is rotated, the lever 25 moves with the spout as illustrated in FIG. 3. Thus, the user may refer to the direction of the delivery spout 14 to determine the directions in which he must move the operating lever 25 to adjust the flow rate of water and the desired temperature. This is what he is accustomed to do when using faucets with fixed delivery spouts. Furthermore, the operating lever 25 is always aligned over the spout 14 when in the shut-off position.

Figure 6:
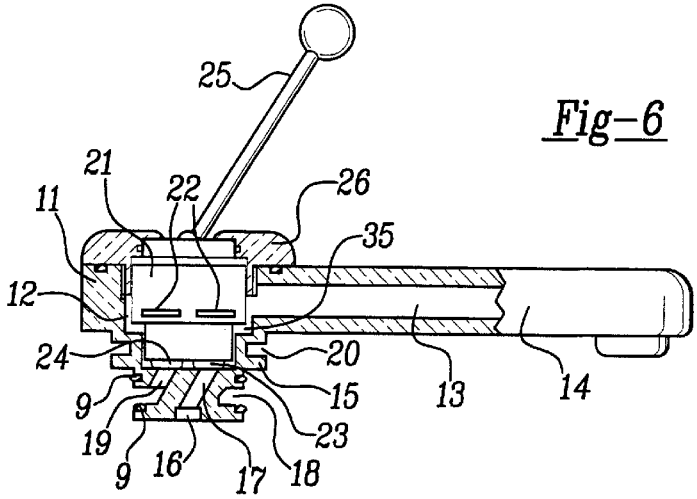
FIG. 6 shows the adjustable component and spout mounting the mixing cartridge in FIG. 4.

Reference now is made to FIGS. 4 and 6 to illustrate the recess or cavity 35 in the rotating component 11. The cavity 35 that receives the mixing cartridge 21 offers a peripheral area or gap 12, into which open out the lateral delivery openings 22 of the cartridge 21 (which is of the open type). The gap 12 communicates directly with passage 13 of the delivery spout 14.

Figure 5:
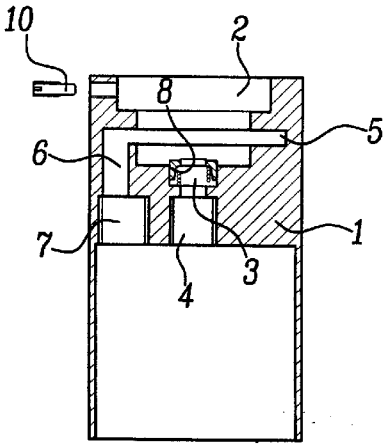
FIG. 5 shows the fixed body in FIG. 4.

It is apparent that, in modifications, the delivery spout 14 can be a component that is structurally separate from the rotating component 11 and is appropriately connected to component 11. In addition, the recess or cavity 35 that receives the mixing cartridge 21 may not be directly formed in the rotating component 11 but in a component structurally separate and in turn installed in rotating component In order to ensure proper supply to the mixing cartridge 21, a two-way hydraulic connection is between the rotating component 11 and the fixed body 1 of the faucet. This connection can be better seen with reference to FIGS. 5 and 6. The rotating component 11 offers a projecting part 15 which offers a central opening 16 and a peripheral ring chamber 18. The central opening 16 communicates, via a channel 17, with a first inlet 23 to the cartridge 21, while the peripheral ring chamber 18 communicates, via a channel 19, with the second inlet 24 of the cartridge 21.

The fixed body 1 itself of the faucet has a cavity 2 intended to rotatably receive the projecting part 15 of the rotating component 11. Fixed body 1 has a central opening 3 which communicates with a connection 4 for a first supply pipe (not shown), and a peripheral ring chamber 5 which communicates via a passage 6 with a connection 7 for the second supply pipe (not shown). The parts described are designed so that, when the rotating component 11 is mounted on the fixed body 1 of the faucet, the central openings 3 and 16 can communicate with each other and chambers 5 and 18 communicate with each other. The respective passages are watertight due to seal 8 in opening 3 and ring seals 9 about ring chamber 18. In this way the supply of cold and hot water to the cartridge 21 is ensured for every rotated position of the delivery spout 14.

The projecting part 15 of the rotating component 11 also offers a peripheral ring groove 20 into which receives a retaining screw 10 screwed through the fixed body 1. The screw 10 mechanically couples the rotating component 11 in place axially without inhibiting its rotation. The ring groove 20 can be an incomplete arc for the purpose of limiting the field of rotation allowed to the rotating component 11 and to the delivery spout 14. Correspondingly the peripheral ring chambers 5 and 18 may be incomplete arcs along the circumference.

It is understood that in other forms of embodiment, the two-way rotating hydraulic connection between the fixed body 1 and the rotating component 11 can be structured differently, as is known in the prior art for these hydraulic connections. Also, multiple screws 20 may be received circumferentially about parts of the groove 20 to rotationally secure component 11 to the fixed body 1.

Moreover, the control lever 25 is represented as a straight leg or pole but for certain applications it can be molded and shaped and used with the same internal valve mechanism. For example, the lever 25 may be contoured towards the delivery spout as is found in many known faucets.

The central shut-off position of the "joystick" ever 25 always corresponds to the direction of the adjustable spout 14. This shut-off position is selected so that the user is always certain of reaching complete shut-off by moving the lever towards the delivery spout. However, for certain applications, the shut-off position may be reversed, i.e. lifted up in opposition or away from spout 14 or may even be set at a 90 degree offset position for certain applications. In all situations, the shut-off position is permanently set with respect to the spout. Secondly, the orientation of operation is also set with respect to the spout. The application of the invention therefore offers two major advantages for valves with "joystick" operating lever.

Figure 7:
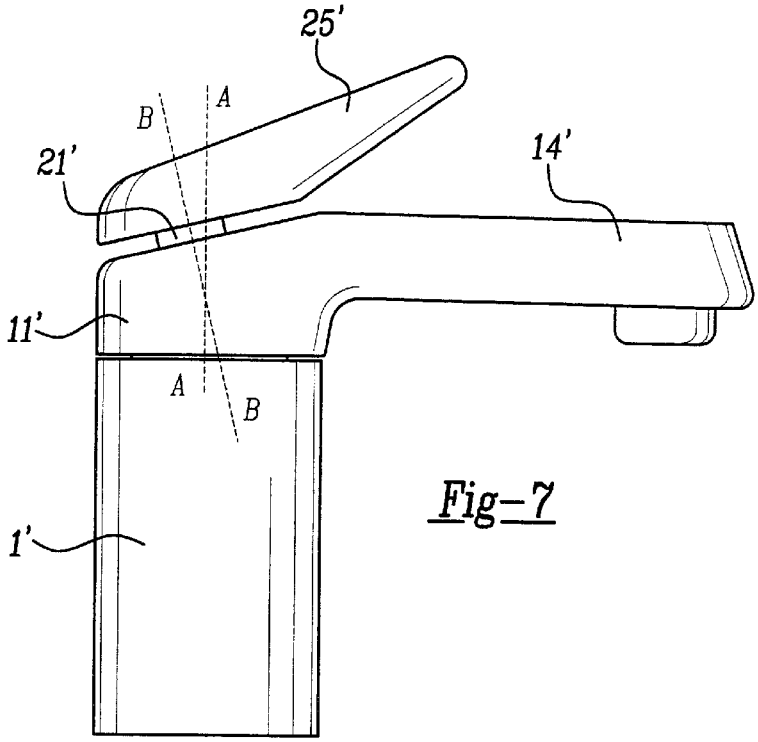
FIG. 7 illustrates a side elevational view of another embodiment of a faucet in accordance with the invention.

The invention can naturally be applied also to faucets of different shapes and different valve operations from that represented in FIGS. 2 to 6. For example, FIG. 7 illustrates how the invention can be applied to a faucet on whose fixed body 1 is not of the so called "joystick" type. FIG. 7 illustrates a valve that is subject to rotation about axis B—B for temperature adjustment and movement about an orthogonal axis for flow adjustment. The handle may be aesthetically contoured for ease of operation about axis B—B for temperature control and for movement about the orthogonal axis for flow control. Moreover, in this example, the cartridge is mounted, in relation to the rotating component 11, on the axis B—B which forms an angle with the axis of rotation A—A of the adjustable spout. Both axis A—A and B—B are in the plane of the drawings and aligned with the center vertical plane of the spout 14. These arrangements can turn out to be preferable in some cases, especially in view of certain shapes of the control lever. In this type of faucet, there are many shut-off positions along an arc where the lever is in a down position away from axis B—B. As such, the lever need not be aligned with the spout to completely shut off the faucet. The user still needs an orientation to correctly set the temperature. Usually, the mix position is in the center of the adjustable field of operation and is centered with a fixed spout. In the present invention the center of the adjustable field is oriented with the adjustable spout and rotated therewith. The application of the invention provides the orientation for the correct operation of the control lever 25.

Figure 8:
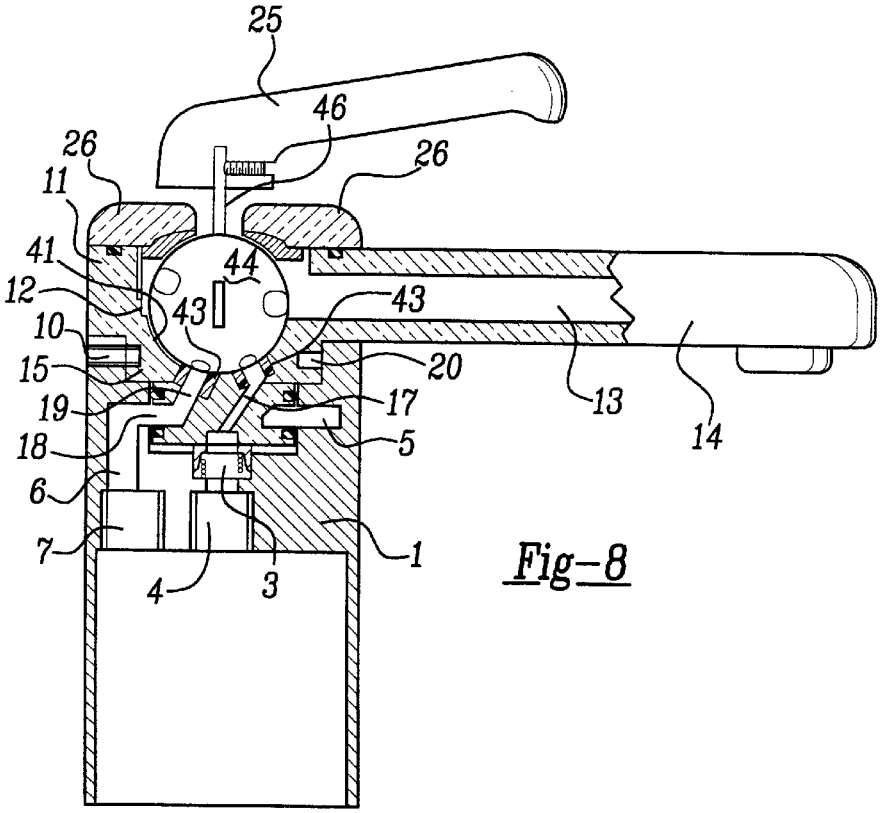
FIG. 8 is a segmented view of another embodiment of the invention.

FIG. 8 illustrates another embodiment of invention incorporating a ball valve that is not a cartridge format. In this embodiment, the rotating component 11 has a recess 41 shaped to receive valve seals 43 in the downstream ends of passages 17 and 19 that seat flushly against ball valve 44. Ball valve 44 has a control stem 46 passing through cap 26 and is affixed to operating lever 25. The ball valve 44 is not in a cartridge format but is merely installed in appropriately shaped recess 41 in component 11. Nevertheless, as spout 14 is adjusted, component 11 is also rotated and carries with it the ball valve 44 and operating lever 25 such that the operation of lever 25 is always oriented with respect to the spout 14. The actual internal drive components of the ball valve 44 are well known in the prior art and do not form part of this invention.

It must be understood that the invention is not limited to the form of embodiments described and illustrated as examples. Other variations and modifications are possible without departing from the scope and spirit of the present invention as defined by the appended claims.

The embodiments in which an exclusive property or privilege is claimed are defined as follows:

1. A faucet which includes a fixed body having supply ports, an adjustable delivery spout and a mixing valve cartridge with a single operating lever mounted to the fixed body; said faucet characterized by:

a component of the valve affixed with respect to the delivery spout and rotatable about an axis of rotation in relation to the fixed body of the valve;

said mixing valve cartridge installed through an upper opening of a cavity and into said cavity within said component; said upper opening having said axis of rotation intersecting therewith and said cartridge secured within said cavity in said component for rotation with said component; and, said single control lever having its base operably mounted to said cartridge for rotation therewith.

2. A faucet as defined in claim 1 further characterized by said component being integrally formed with said spout.

3. A faucet as defined in claim 1 further characterized by;

said mixing cartridge having lateral delivery openings in direct communication with a peripheral gap between said mixing cartridge and said component, said gap communicating directly with an internal passage in the delivery spout.

4. A faucet as defined in claim 1 further characterized by:

said component which mounts the mixing valve cartridge is mounted in turn to the fixed body of the faucet by a two-way rotating hydraulic coupling.

5. A faucet as defined in claim 4 further characterized by:

said rotating hydraulic coupling having a central passage in communication with one of the supply ports, and a peripheral chamber at least partially ring-shaped in fluid communication with the other supply port.

6. A faucet as defined in claim 1 further characterized by:

said mixing cartridge being installed in said component such that Its central axis is coincident with the axis of rotation of the adjustable spout.

7. A faucet as defined in claim 1 further characterized by:

said mixing cartridge being installed in said component such that its longitudinal axis is canted with respect to the axis of rotation of the adjustable spout.

8. A faucet as defined in claim 7 further characterized by:

the longitudinal axis of the mixing valve being canted such that it extends down and toward the front end of the spout and lies in the central vertical plane of said spout.

9. A faucet, as defined in claim 1 further characterized by:

the operating lever being generally elongated and operably connected to the mixing valve cartridge which is moveable in a first direction from a shut-off position to a full flow position to regulate the flow rate of mixed water and in a second direction orthogonal to the first direction to regulate the mixing ratio between hot and cold water.

10. A faucet as defined in claim 9 further characterized by:

said operating lever extending forward and aligned with the central vertical plane of said spout when said operating lever is in the shut-off position.

11. A faucet which includes a fixed body connectable to supply ports, an adjustable delivery spout, an operable mixing valve operated by a single operating control lever, said faucet characterized by:

a component of the valve affixed with respect to the spout and rotably adjustable on the fixed body about an axis of rotation; the operable mixing valve installed through an upper opening of a cavity in said component; said upper opening having said axis of rotation intersecting therewith; said operable mixing valve secured within said cavity for rotation with the component and spout relative to the fixed body;

said single operating lever having its base operably mounted to said mixing valve in proximity to said axis of rotation for rotation with said component about said axis.

12. A faucet as defined in claim 11 further characterized by:

said operating lever moveable to form a field of use and the center plane of the field of use being aligned with the central vertical plane of said spout.

13. A faucet as defined in claim 11 further characterized by:

said lever extending forward and aligned with the central vertical plane of said spout when said lever is in the shut-off position.

14. A faucet as defined in claim 13 further characterized by:

said operating lever moveable to form a field of use and the center plane of the field of use being aligned with the central vertical plane of said spout.

* * * * *